United States Patent [19]

Hofer et al.

[11] Patent Number: 4,717,317

[45] Date of Patent: Jan. 5, 1988

[54] RECIPROCATING PUMP

[75] Inventors: Robert Hofer, Elgg; Anton Steiger, Illnau, both of Switzerland

[73] Assignee: Sulzer Brothers Limited, Winterthur, Switzerland

[21] Appl. No.: 801,091

[22] Filed: Nov. 22, 1985

[30] Foreign Application Priority Data

Feb. 5, 1985 [CH] Switzerland ..... 506/85

[51] Int. Cl.[4] ..... F04B 9/10

[52] U.S. Cl. ..... 417/392; 92/51

[58] Field of Search ..... 92/51, 53, 169.2, 110, 92/92, 162 R; 417/240, 241, 392

[56] References Cited

U.S. PATENT DOCUMENTS

| | | | |
|---|---|---|---|
| 512,776 | 1/1894 | Weathehead | 417/392 |
| 2,428,460 | 10/1947 | Inglis | 417/392 |
| 2,828,694 | 4/1958 | Nallinger | 417/392 X |
| 3,482,401 | 12/1969 | Waite | 417/225 X |
| 3,490,344 | 1/1970 | Archer et al. | 92/169 X |
| 3,572,035 | 3/1971 | Beroset | 417/392 X |
| 3,877,349 | 4/1975 | Schindel | 92/53 |
| 3,932,989 | 1/1976 | Demetrescu | 417/392 X |
| 4,438,872 | 3/1984 | Dooley et al. | 417/392 X |
| 4,527,464 | 7/1985 | Frey | 92/153 X |
| 4,536,135 | 8/1985 | Olsen et al. | 417/383 |

*Primary Examiner*—Carlton R. Croyle
*Assistant Examiner*—Theodore Olds
*Attorney, Agent, or Firm*—Kenyon & Kenyon

[57] ABSTRACT

The reciprocating pump is provided with a sleeve between the piston and the casing. The sleeve is disposed in spaced relation to define an annular gap both with respect to the piston and with respect to the casing. The sleeve is also biased by a spring into sealing engagement with the end wall of the casing. The end of the sleeve adjacent to the spring provides a permanent connection between the gap between the casing and sleeve and the pressure medium used to drive the piston of the pump so that the same pressure prevails on the inside and outside surfaces of the sleeve.

9 Claims, 2 Drawing Figures

RECIPROCATING PUMP

Figure 1:
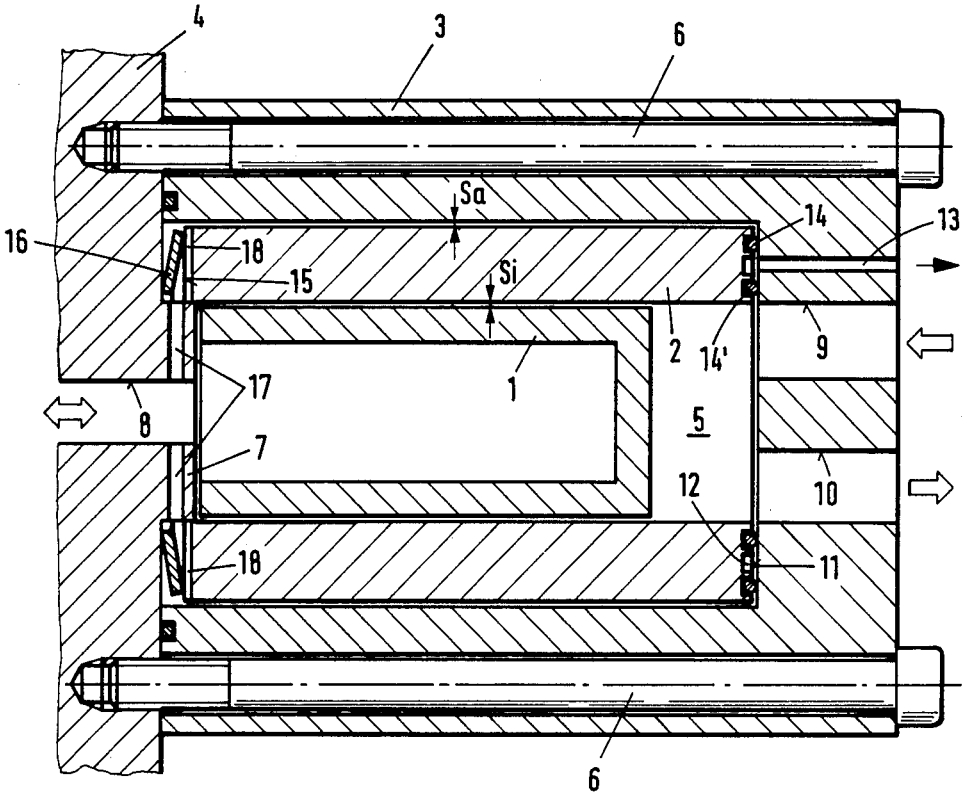

This invention relates to a reciprocating pump. More particularly, this invention relates to a reciprocating pump having a piston driven by a hydraulic pressure medium.

Heretofore, it has been known to employ reciprocating pumps having a piston driven by a hydraulic pressure medium in order to convey another medium, for example, a suspension of a finely divided solid fuel in a liquid. Media of this kind consist, for example, of petroleum coke or coal ground to very fine particles of a size between 5 and 20 μm and suspended in water or oil or both. These suspensions are known as slurries and are used, for example, as fuel for high-power diesel engines. Other conveyed media may also be used, for example, asphalt.

One requirement for the conveyance of the above kinds of media is that there should be the least possible exchange between the medium being conveyed and the pressure medium driving the piston in the gap between the piston and the surrounding cylnder of the reciprocating pump. Usually, at relatively low pressures, for example, of up to three hundred (300) bar, exchange is very small. Hence, no particular action is required in order to eliminate the exchange. However, at much higher pressures, that is up to one thousand (1000) bar, such as used for fuel injection in large diesel engines, the gap between the piston and the cylinder may increase ten-fold as compared with a pressureless state because of cylinder wall expansion. Consequently, although the pressure differences across the piston are low, the exchange of media and associated losses of conveyed medium and/or pressure medium, increases to an unacceptable degree.

Accordingly, it is an object of the invention to reduce the exchange between a driving medium and a conveyed medium in a reciprocating pump to a minimum.

It is another object of the invention to provide a simple technique for precluding an exchange between a driving medium and a conveyed medium in a reciprocating pump at very high pressures, for example, up to approximately one thousand bar.

Briefly, the invention provides a reciprocating pump which is comprised of a casing having a delivery chamber for receiving and expelling a liquid fuel suspension, a sleeve disposed in the casing in spaced relation to define a first annular gap and a piston disposed in the sleeve to be driven by a hydraulic pressure medium and which is in spaced relation to the sleeve to define a second annular gap therebetween. The sleeve is positioned to have an end face sealingly engaging a mating surface of the casing adjacent the delivery chamber while the opposite end face is in permanent communication with the gap between the casing and sleeve.

With this construction, when the pump operates, even at very high delivery pressures, the gap between the piston and the sleeve remains as small as in the pressureless state since the pressure which is operative in this gap is also operative in the gap between the sleeve and the casing, thus obviating any expansion of the sleeve. Since the end face of the sleeve adjacent the delivery chamber is pressed in seal-tight manner onto the casing, now medium can enter the outer gap. This reliably obviates any appreciable exchange between the driving medium on the piston and the conveyed medium in the delivery chamber. Further, if a coal slurry is being conveyed, fine particles of fuel cannot clog the gap between the piston and the sleeve and thereby inhibit piston movement.

Figure 2:
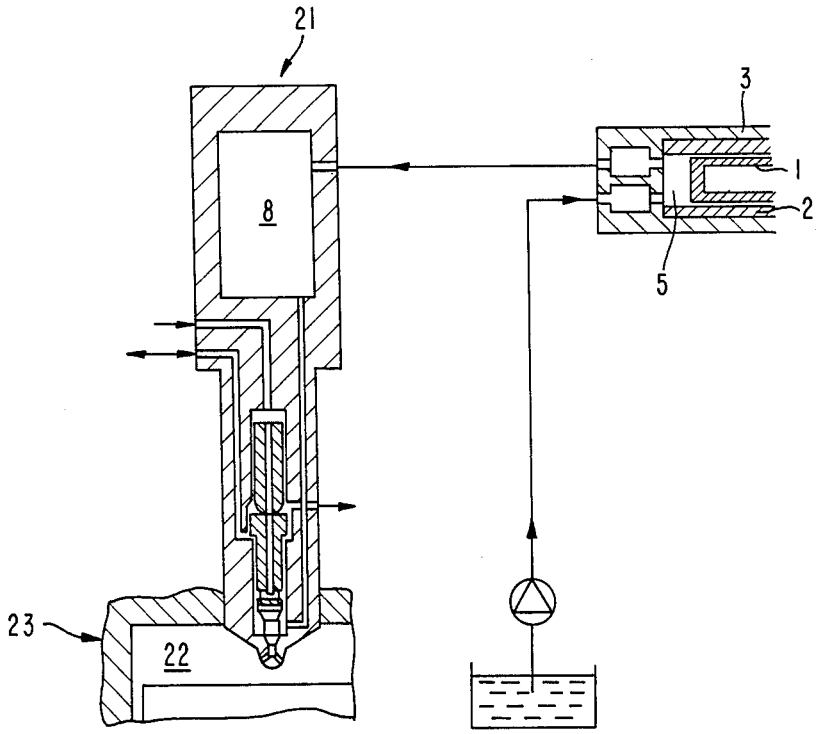

These and other objects and advantages of the invention will become more apparent from the following detailed description taken in conjunction with the accompanying drawing wherein:

FIG. 1 illustrates an axial cross sectional view through a reciprocating pump in accordance with the invention; and FIG. 2 schematically illustrates a reciprocating pump in combination with a diesel engine fuel injection system in accordance with the invention.

Referring to FIG. 1, the reciprocating pump has a piston 1 which is acted on, from the left, as viewed, by a hydraulic medium which is operative as a driving medium and which moves the piston 1 to the right for a delivery stroke. In addition, a unitary sleeve 2 extends around the piston 1 and forms a pump cylinder. As indicated, the piston 1 is disposed in the sleeve 2 in order to define an annular gap Si therebetween.

The pump also has a casing 3 which extends around the sleeve 2 in spaced relation in order to define an annular gap Sa. The casing 3 is of a substantially cup shape and has an end wall which bounds a delivery chamber 5 within the casing 3. As indicated, the casing 3 is secured by a number of screws 6 to a plate 4 which has a centering projection 7 extending into the sleeve 2. This centering projection 7 serves as an abutment for the piston 1 during movement of the piston 1 to the left, as viewed.

The projection 7 is formed with a bore 8 at the center to serve as a means for delivering a flow of pressure medium, such as a hydraulic pressure medium to drive the piston 1 towards the delivery chamber 5. The casing end wall which bounds the delivery chamber 5 is provided with two bores 9, 10 which serve to receive and expel a liquid fuel suspension. Each of the bores 9, 10 also contain an inlet valve and a delivery valve, respectively (not shown). These valves may take the form of an inherently stable check valve, for example as described in copending U.S. patent application Ser. No. 801,095, filed Nov. 22, 1985.

The end face 11 of the sleeve 2 which is adjacent to the delivery chamber 5 is formed with an annular groove 12 which is concentric to the longitudinal axis of the sleeve 2 and which communicates with a relief bore 13 in the end wall of the casing 3. This end face 11 sealingly engages a mating surface of the casing 3 via a pair of O-rings 14, 14' so as to seal the gap Sa and the chamber 5, respectively in relation to the groove 12. As indicated, the O-rings 14, 14' are disposed on opposite sides of the annular groove 12.

An annular cup spring 16 is provided on the opposite end of the sleeve 2, that is, between the end face 15 of the sleeve 2 and the adjacent plate 4. This spring 16 presses the sleeve 2 in sealing relation onto the end wall of the casing 3.

In addition, a pair of radial bores 17 extend through the centering projection 7 of the plate 4 from the bore 8 to the chamber receiving the spring 16. The end face 15 of the sleeve 2 is also formed with a number of radial grooves 18 which ensure that the driving medium supplied by way of the bores 8, 17 reaches the outer gap Sa between the sleeve 2 and the casing 3. In this way, the end face 15 of the sleeve 2 is in permanent communication with the gap Sa between the casing 3 and the sleeve 2.

The reciprocating pump is intended, for example, to convey a liquid medium in the form of a suspension of finely divided solids, such as coal, in a liquid, such as water and to supply the medium to a combustion process. When the pump is in operation, a feed pump (not shown ) forces the liquid medium to be conveyed through the delivery bore 9 into the delivery chamber 5. At this time, the pressure of the driving medium in the bore 8 is at a lower state so that the piston 1 moves to the left, as viewed. During the delivery stroke, the driving medium supplied through the bore 8 is at a much higher pressure than the liquid medium to be conveyed. Hence, with the inlet valve (not shown) in the bore 9 closing and the delivery valve (not shown) in the bore 10 opening, the piston 1 moves to the right, as viewed and displaces the liquid medium from the chamber 5 into a delivery line (not shown).

Simultaneously, as the piston 1 is actuated, the driving medium which is at a pressure, for example of one thousand (1000) bar, enters the two gaps Si, Sa. As a result, the inner generated surface and the outer generated surface of the sleeve 2 experience substantially the same pressure. Hence, the sleeve 2 cannot expand. Thus, the inner gap Si remains the same size at high pressure as in the absence of pressure. Consequently, penetration of the liquid medium to be conveyed is substantially obviated into the inner gap Si. However, the outer gap Sa expands under the pressure of the driving medium but does not lead to the entry of liquid medium into the outer gap Sa from the delivery chamber 5. This is because the end face 11 of the sleeve 2 is sealingly pressed by the spring 16 onto the end wall of the casing 3. This pressing effect is further boosted by the high pressure of the driving medium acting on the opposite end face 15 of the sleeve 2 and by the groove 12 which communicates with the relief bore 13 in the casing end wall.

A reliable sealing effect is therefor provided while the sleeve 2 has free radial mobility. This latter feature is very important when there are substantial temperature differences between the medium to be conveyed and the environment, for example, as is the case when the pump is required to convey asphalt.

The reciprocating pump may also be used in combination with a diesel engine fuel injection system for injecting a liquid fuel suspension to a combustion chamber. For example, as shown in FIG. 2, the pump may be used as a hydraulic pump in a fuel injection system 21 for injecting a coal slurry into the combustion chamber 22 of a reciprocating internal combustion engine 23, for example as described in copending U.S. patent applicatin Ser. No. 801,095, filed Nov. 22, 1985. The pressure medium driving the piston can, in this case, be diesel oil or lubricating oil and the pump delivery line may be connected to the injection valve of the engine.

The invention thus provides a reciprocating pump which is able to substantially preclude an exchange of media between a medium being conveyed and a medium driving the piston of the pump.

The invention also provides a relatively simple construction which can be employed in a reciprocating pump to obviate exchange between media operative in the pump.

What is claimed is:

1. A reciprocating pump comprising a casing having a delivery chamber for receiving and expelling a liquid fuel suspension;

a sleeve disposed in said casing in spaced relation to define a first annular gap therebetween, said sleeve having an end face sealingly engaging a mating surface of said casing adjacent said delivery chamber and an opposite end face in permanent communication with said gap;

a piston disposed in said sleeve to be driven by a hydraulic pressure medium and being in spaced relation to said sleeve to define a second annular gap therebetween; and means for delivering a flow of pressure medium to drive said piston towards said delivery chamber, said means being in communication with each said annular gap to deliver the pressure medium thereto to obviate radial expansion of said sleeve.

2. A pump as set forth in claim 1 wherein said end face includes an annular groove concentric to said sleeve and said casing includes a relief bore communicating with said groove.

3. A pump as set forth in claim 2 which includes an O-ring on each side of said groove and between said casing and said sleeve.

4. A pump as set forth in claim 1 wherein said sleeve includes at least one radial groove in said opposite end face communicating with said first annular gap.

5. A pump as set forth in claim 1 which further comprises a compression spring between said opposite end face of said sleeve and a plate secured to and across said casing to bias said sleeve against said mating surface of said casing.

6. A reciprocating pump as set forth in claim 1 wherein said casing has an end wall having said mating surface thereon, a first bore in said end wall for delivering a liquid fuel suspension into said delivery chamber and a second bore in said end wall for expelling a liquid fuel suspension from said delivery chamber.

7. A reciprocating pump as set forth in claim 1 which further comprises a plate secured to and across said casing and having a bore for delivering a pressure medium to drive said piston into said delivery chamber.

8. In combination a diesel engine fuel injection system for injecting a liquid fuel suspension to a combustion chamber; and a reciprocating pump for delivering a liquid fuel suspension to said system, said pump including a casing having a delivery chamber for receiving a liquid fuel suspension for delivery to said system, a sleeve disposed in said casing in spaced relation to define a first annular gap therebetween, said sleeve having an end face sealingly engaging a mating surface of said casing adjacent said delivery chamber and an opposite end face in permanent communication with said gap, a hydraulically actuated piston disposed in said sleeve in spaced relation to define a second annular gap therebetween and means for delivering a flow of pressure medium to drive said piston towards said delivery chamber, said means being in communication with each said annular gap to deliver the pressure medium thereto to obviate radial expansion of said sleeve.

9. A reciprocating pump comprising a casing having a delivery chamber for receiving and expelling a liquid fuel suspension;

a sleeve disposed in said casing to define a first annular gap therebetween, said sleeve having one end face facing a mating surface of said casing and an opposite end face;

a piston disposed in said sleeve to define a second annular gap therebetween;

a compression spring at said opposite end face of said sleeve to bias said sleeve at said one end face into sealing relation with said mating surface of said casing;

means for delivering a flow of pressure medium to within said sleeve to drive said piston towards said delivery chamber and into said second annular gap; and at least one radial groove in said opposite end face of said sleeve communicating said means with said first annular gap to deliver the pressure medium to said first annular gap.

* * * * *

UNITED STATES PATENT AND TRADEMARK OFFICE

CERTIFICATE OF CORRECTION

PATENT NO. : 4,717,317

DATED : January 5, 1988

INVENTOR(S) : ROBERT HOFER

It is certified that error appears in the above-identified patent and that said Letters Patent is hereby corrected as shown below:

Column 1, line 65 "now" should be -no-

Signed and Sealed this

Sixteenth Day of August, 1988

*Attest:*

*Attesting Officer*

DONALD J. QUIGG

*Commissioner of Patents and Trademarks*